United States Patent [19]

Yagihara et al.

[11] Patent Number: 4,690,885

[45] Date of Patent: Sep. 1, 1987

[54] SILVER HALIDE PHOTOGRAPHIC MATERIAL

[75] Inventors: Morio Yagihara; Akihiko Ikegawa, both of Kanagawa, Japan

[73] Assignee: Fuji Photo Film Co., Ltd., Kanagawa, Japan

[21] Appl. No.: 787,957

[22] Filed: Oct. 16, 1985

[30] Foreign Application Priority Data

Oct. 16, 1984 [JP] Japan ..... 59-216926

[51] Int. Cl.[4] ..... G03C 1/40; G03C 1/06; G03C 1/34; G03C 1/42

[52] U.S. Cl. ..... 430/212; 430/218; 430/219; 430/222; 430/227; 430/251; 430/443; 430/543; 430/544; 430/559; 430/561; 430/564; 430/566; 430/510; 430/598; 430/607; 430/611; 430/955; 430/957; 430/958; 430/959

[58] Field of Search ..... 430/218, 219, 251, 443, 430/544, 611, 955, 957, 958, 959, 212, 559, 561, 566, 598, 607, 222, 564, 543, 510, 227

[56] References Cited

U.S. PATENT DOCUMENTS

| | | | |
|---|---|---|---|
| 4,139,379 | 2/1979 | Chasman et al. | 430/223 |
| 4,334,010 | 6/1982 | Mifone et al. | 430/611 |
| 4,350,754 | 9/1982 | Bartels-Keith et al. | 430/611 |
| 4,358,525 | 11/1982 | Mooberry et al. | 430/955 |
| 4,371,604 | 2/1983 | Van de Sande et al. | 430/955 |
| 4,409,323 | 10/1983 | Sato et al. | 430/957 |
| 4,416,977 | 11/1983 | Ohashi et al. | 430/955 |
| 4,420,554 | 12/1983 | Ohashi et al. | 430/955 |
| 4,522,917 | 6/1985 | Ichijima et al. | 430/955 |
| 4,564,587 | 1/1986 | Watanabe et al. | 430/957 |

*Primary Examiner*—Richard L. Schilling

*Attorney, Agent, or Firm*—Sughrue, Mion, Zinn, Macpeak, and Seas

[57] ABSTRACT

A silver halide photographic material which comprises a support having coated thereon a light-sensitive silver halide emulsion layer, wherein the photographic material contains at least one blocked photographic agent represented by the following general formula (I):

(I)

wherein A represents a photographic agent moiety which is bonded to a blocking moiety through a hetero atom, or a precursor thereof; $R^1$, $R^2$ and $R^3$ each represents a hydrogen atom, or a substituent group; and Z represents atoms necessary to form a carbocyclic ring or a heterocyclic ring (except for a heterocyclic ring which contains an NH group at the position adjacent to the carbon atom to which $R^1$ is attached). The blocked photographic agent is completely stable upon storage of the photographic material, and releases a photographic agent at a desired time upon processing. The blocked photographic agent also exhibits its function to a substantial degree over a wide range of pH.

32 Claims, No Drawings

SILVER HALIDE PHOTOGRAPHIC MATERIAL

FIELD OF THE INVENTION

The present invention relates to a silver halide photographic material and, more particularly, to a silver halide photographic material containing a precursor compound of a photographically useful agent in which the active group is blocked.

BACKGROUND OF THE INVENTION

The manner of prior incorporation of photographically useful agents in a photographic light-sensitive material to fully achieve the effects of the agents differs from the manner in which they are used in processing solutions. For instance, photographic agents of the kind which cannot withstand long range storage in processing solutions because of their liability to decomposition under acid-alkaline or oxidation-reduction conditions can be utilized effectively and at the same time, the composition of a processing solution can be simplified to facilitate the preparation thereof. Further, in processing a light-sensitive material, it becomes feasible for a desired photographic agent to fulfill its function at a desired time and/or at a desired place, that is to say, only in a specific layer or layers in the vicinity thereof where the light-sensitive material has a multilayer structure, or for a desired photographic agent to be present in such an amount as to vary as a function of silver halide development. However, if the photographic agent is added to a photographic material in an active form, it undergoes reactions with other components present in the photographic light-sensitive material or decomposes under the influence of heat or oxygen during storage prior to processing. Therefore, it becomes impossible to achieve fully the expected capabilities at the time of processing. One solution to this problem is a method in which a photographic agent is converted into a substantially inactive form by blocking the active group, that is, a precursor thereof, and then the precursor is added to a photographic light-sensitive material. When the useful photographic agent is a dye, a functional group having a great effect on spectral absorption of the dye is blocked and, thereby, its spectral absorption is shifted to the shorter or the longer wavelength side. Under this circumstance, even if the blocked dye is also present in a silver halide emulsion layer with a spectral sensitivity in the wavelength region corresponding to the spectral absorption of the original dye, a lowering of sensitivity due to the so-called filter effect does not occur. Therefore, it can be used advantageously. When the photographically useful agent is an antifoggant or a development inhibitor, blocking of the active group can offer many advantages, e.g., desensitization due to adsorption onto light-sensitive silver halide grains and formation of silver salts upon storage can be inhibited, and at the same time, through timely release of such photographic agents, fog can be reduced without impairing photographic speed, fog arising from overdevelopment can be stopped at a desired time, and so on. When the photographically useful agent is a developer, an auxiliary developer or a fogging agent, blocking the active group or the adsorptive group can offer the advantages that various photographically adverse effects due to conversion into semiquinones or oxidants through air oxidation on storage can be prevented, or injection of electrons into silver halides can be prevented from occurring during storage. Thereby, generation of fog nuclei can be inhibited. This results in the realization of stable processing, and the like. When the photographically useful agent is a bleach accelerator or a bleach-fix accelerator, blocking the active group can offer the advantages that in storing the light-sensitive material, reactions with other components present together with such an agent can be suppressed, while in processing it, the expected ability can be brought into full play upon removal of the blocking group at the time needed. In the present invention the above described active group, functional group and adsorptive group are generally referred to as active group.

As described above, to use a photographic agent in the form of a precursor thereof turns out to be an extremely effective means of freely achieving the ability of the photographic agent. However, precursors thereof have very severe requirements for practical use. That is, they must satisfy two contradictory requirements; one is ensuring stable presence of the precursor under a storage condition, and the other is ensuring rapid and highly efficient release of the photographic agent by removal of the blocking group at a desired time upon processing.

Several techniques for blocking photographic agents are already known. For example, well known techniques involve utilization of a blocking group such as an acyl group, a sulfonyl group or the like, as described in Japanese Patent Publication No. 44805/72 (corresponding to U.S. Pat. No. 3,615,617); utilization of a blocking group which releases a photographic agent due to the so-called reverse Michael's reaction, as described in Japanese Patent Publication Nos. 39727/79 (corresponding to U.S. Pat. No. 3,674,478), 9696/80 (corresponding to U.S. Pat. No. 3,791,830) and 34927/80 (corresponding to U.S. Pat. No. 4,009,029); utilization of a blocking group which releases a photographic agent by an intramolecular electron transfer accompanying the production of quinone methide or the analogues thereof, as described in U.S. Pat. No. 4,350,754, Japanese Patent Publication No. 39727/79, and Japanese Patent Application (OPI) Nos. 135944/82, 135945/82 and 136640/82 (the term "OPI" as used herein refers to a "published unexamined Japanese patent application"); utilization of the intramolecular ring closure reaction described in Japanese Patent Application (OPI) No. 53330/80 (corresponding to U.S. Pat. No. 4,310,612); utilization of the cleavage of a 5- or 6-membered ring described in Japanese Patent Application (OPI) Nos. 76541/82 (corresponding to U.S. Pat. No. 4,335,200), 135949/82 and 179842/82; and so on.

However, photographic agents blocked using these known techniques have the disadvantages that, for example, some precursors which are stable under storage conditions release photographic agents too slowly at the time of processing and, therefore, they require the processing under high alkalinities of a pH of 12 or above, some precursors which have sufficiently high release speeds at the time of processing under mild conditions of a pH of 9 to 11 decompose slowly under storage conditions, thereby impairing their function as a precursor, some precursors which allow little latitude in controlling the release speed at the time of processing require a very narrow pH range for effecting the processing, and so on.

SUMMARY OF THE INVENTION

Therefore, an object of the present invention is to provide a precursor of a photographic agent which is completely stable under storage conditions and can release the photographic agent at a desired time upon processing.

Another object of the present invention is to provide a precursor of a photographic agent which can exhibit its function to a substantial degree over a wide pH range.

These objects of the present invention are attained with a silver halide photographic material which comprises a support having coated thereon a light-sensitive silver halide emulsion layer, wherein the silver halide photographic material contains at least one blocked photographic agent represented by the following general formula (I):

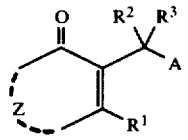

(I)

wherein A represents a photographic agent moiety which is bonded to a blocking moiety through a hetero atom, or a precursor thereof; $R^1$, $R^2$ and $R^3$ each represents a hydrogen atom, or a substituent group; and Z represents atoms necessary to form a carbocyclic ring or a heterocyclic ring (except for a heterocyclic ring which contains an >NH group at the position adjacent to the carbon atom to which $R^1$ is attached).

DETAILED DESCRIPTION OF THE INVENTION

In the foregoing general formula (I), A is preferably a group represented by the formula (II):

$$-(X)_m B \qquad \text{(II)}$$

wherein B represents a photographic agent moiety which is bonded to X through a hetero atom contained in B; X represents a divalent linkage group which is bonded to a blocking moiety through a hetero atom contained in X; and m is 0 or 1.

Useful photographic agents, a monovalent residue of which is represented by B in the foregoing general formula (II), are known photographic agents which have at least one hetero atom and enter into combination with the blocking moiety through the hetero atom. Specific examples of such photographic agents which can be employed in the present invention include antifoggants and development inhibitors, such as mercaptotetrazoles, mercaptotriazoles, mercaptopyrimidines, mercaptobenzimidazoles, mercaptoimidazoles, mercaptobenzoxazoles, mercaptobenzthiazoles, mercaptothiadiazoles, benzotriazoles, indazoles and the like; developing agents such as p-phenylenediamines, hydroquinones, p-aminophenols and so on; auxiliary developing agents such as pyrazolidones; fogging agents such as hydrazines, hydrazides and so on; silver halide solvents such as hypo (i.e., sodium thiosulfate) and so on; bleach accelerating agents such as aminoalkylthiols and so on; and dyes such as azo dyes, azomethine dyes and so on. In addition, photographic agents of the kind which further possess a redox function as to enable the release of the photographic agents as described above as a function of silver halide development, for example, coloring materials for color diffusion transfer photographic materials and DIR (development inhibitor releasing) hydroquinones, can also be employed as useful photographic agents.

The above described useful photographic agents may be bonded directly (when M=0 in the general formula (II)) to the blocking moiety through their hetero atom, or may be bonded via X (when m=1 in the general formula (II)) to the blocking moiety.

X represents a divalent linkage group, and it is bonded to the blocking moiety through a hetero atom contained therein. The bond formed between X and the blocking moiety is cleaved upon processing, and the resulting X-B splits per se rapidly to release a photographic agent corresponding to B. Specific examples of linkage groups of the above described kind include those which release B upon an intramolecular ring closing reaction, as described in Japanese Patent Application (OPI) No. 145135/79 (corresponding to U.S. Pat. No. 4,248,962 and British Patent Application No. 2,010,818A); those which release B by an intramolecular electron transfer, as described in British Pat. No. 2,072,363, Japanese Patent Application (OPI) No. 154234/82, U.S. Pat. Nos. 4,409,323 and 4,421,845 and so on; those which release B by elimination of carbon dioxide, as described in Japanese Patent Application (OPI) No. 179842/82 and so on; and a divalent timing group of formula $-OCH_2-$ which releases B upon elimination of formaldehyde, as described in Japanese Patent Application No. 203446/82 (corresponding to U.S. Pat. No. 4,522,917); and so on.

Representative examples of the above described linkage groups suitable for X have the structural formulae illustrated below, respectively.

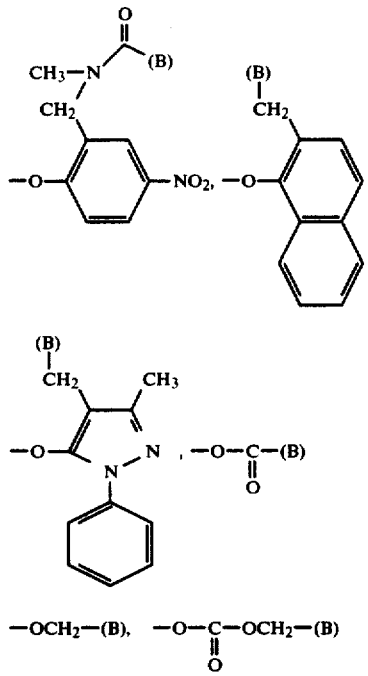

wherein -(B) represents a bond to the photographic agent moiety.

More specifically, in the general formula (I), $R^1$ represents a hydrogen atom, an alkyl group (preferably containing 1 to 20 carbon atoms), an alkenyl group (preferably containing 2 to 20 carbon atoms), an aryl group (preferably containing 6 to 20 carbon atoms), an alkoxy group (preferably containing 1 to 20 carbon atoms), an oxycarbonyl group (preferably an alkyloxycarbonyl group containing 1 to 20 carbon atoms as an alkyl moiety or an aryloxycarbonyl group containing 6 to 20 carbon atoms as an aryl moiety), a carbamoyl group (preferably an alkylcarbamoyl group containing 1 to 20 carbon atoms as an alkyl moiety or an arylcarbamoyl group containing 6 to 20 carbon atoms as an aryl moiety), an acyl group (preferably an alkylcarbonyl group containing 1 to 20 carbon atoms as an alkyl moiety or an arylcarbonyl group containing 6 to 20 carbon atoms as an aryl moiety), a sulfonyl group (preferably an alkylsulfonyl group containing 1 to 20 carbon atoms or an arylsulfonyl group containing 6 to 20 carbon atoms), a sulfinyl group (preferably an alkylsulfinyl group containing 1 to 20 carbon atoms or an arylsulfinyl group containing 6 to 20 carbon atoms), a sulfamoyl group (preferably an alkylsulfamoyl group containing 1 to 20 carbon atoms or an arylsulfamoyl group containing 6 to 20 carbon atoms), and so on.

$R^2$ and $R^3$ each represents a hydrogen atom, an alkyl group (preferably containing 1 to 20 carbon atoms), or an aryl group (preferably containing 6 to 20 carbon atoms).

The foregoing alkyl, alkenyl and aryl groups respectively include those which are further substituted with one or more of various substituent groups as set forth above. Specific examples of the substituent groups include a halogen atom (e.g., a fluorine atom, a chlorine atom, a bromine atom, etc.), an alkyl group (preferably containing 1 to 20 carbon atoms), an aryl group (preferably containing 6 to 20 carbon atoms), an alkoxy group (preferably containing 1 to 20 carbon atoms), an aryloxy group (preferably containing 6 to 20 carbon atoms), an alkylthio group (preferably containing 1 to 20 carbon atoms), an arylthio group (preferably containing 6 to 20 carbon atoms), an acyl group (preferably containing 2 to 20 carbon atoms), an acylamino group (preferably an alkanoylamino group containing 1 to 20 carbon atoms or a benzoylamino group containing 6 to 20 carbon atoms), a nitro group, a cyano group, an oxycarbonyl group (preferably an alkoxycarbonyl group containing 1 to 20 carbon atoms as the alkyl moiety or an aryloxycarbonyl group containing 6 to 20 carbon atoms as the aryl moiety), a hydroxy group, a carboxy group, a sulfo group, a ureido group (preferably an alkylureido group containing 1 to 20 carbon atoms as the alkyl moiety or an arylureido group containing 6 to 20 carbon atoms as the aryl moiety), a sulfonamido group (preferably an alkylsulfonamido group containing 1 to 20 carbon atoms or an arylsulfonamido group containing 6 to 20 carbon atoms), a sulfamoyl group (preferably an alkylsulfamoyl group containing 1 to 20 carbon atoms or an arylsulfamoyl group containing 6 to 20 carbon atoms), a carbamoyl group (preferably an alkylcarbamoyl group containing 1 to 20 carbon atoms as the alkyl moiety or an arylcarbamoyl group containing 6 to 20 carbon atoms as the aryl moiety), an acyloxy group (preferably containing 1 to 20 carbon atoms), an amino group (including an unsubstituted amino group and preferably a seconary or tertiary amino group substituted with an alkyl group containing 1 to 20 carbon atoms or an aryl group containing 6 to 20 carbon atoms), a carbonic acid ester group (preferably an alkyl carbonic acid ester the alkyl moiety of which has from 1 to 20 carbon atoms or an aryl carbonic acid ester the aryl moiety of which has from 6 to 20 carbon atoms), a sulfone group (preferably an alkylsulfone group containing 1 to 20 carbon atoms or an arylsulfone group containing 6 to 20 carbon atoms), and a sulfinyl group (preferably an alkylsulfinyl group containing 1 to 20 carbon atoms or an arylsulfinyl group containing 6 to 20 carbon atoms).

The ring formed with Z includes, for example, a 5-, 6- or 7-membered carbocyclic ring, a 5-, 6- or 7-membered heterocyclic ring which contains one or more hetero atoms such as nitrogen, oxygen, sulfur and so on, or a ring formed by fusing together a carbocyclic or heterocyclic ring and another ring at appropriate sites. Specific examples of such rings include cyclopentenone, cyclohexenone, cycloheptenone, benzocycloheptenone, 4-pyridone, 4-quinoline, 2-pyrone, 4-pyrone, 1-thio-2-pyrone, 1-thio-4-pyrone, coumarin, chromone, uracil and the like.

These carbocyclic and heterocyclic rings may be substituted with one or more substituent groups, and when two or more substituent groups are present, they may be the same or different.

Specific examples of substituent groups which the above described rings may have include a halogen atom (e.g., a fluorine atom, a chlorine atom, a bromine atom, etc.), an alkyl group (preferably containing 1 to 20 carbon atoms), an aryl group (preferably containing 6 to 20 carbon atoms), an alkoxy group (preferably containing 1 to 20 carbon atoms), an aryloxy group (preferably containing 6 to 20 carbon atoms), an alkylthio group (preferably containing 1 to 20 carbon atoms), an arylthio group (preferably containing 6 to 20 carbon atoms), an acyl group (preferably containing 2 to 20 carbon atoms), acylamino group (preferably an alkanoylamino group containing 1 to 20 carbon atoms or a benzoylamino group containing 6 to 20 carbon atoms), a nitro group, a cyano group, an oxycarbonyl group (preferably an alkoxycarbonyl group containing 1 to 20 carbon atoms as the alkyl moiety or an aryloxycarbonyl group containing 6 to 20 carbon atoms as the aryl moiety), a hydroxy group, a carboxy group, a sulfo group, a ureido group (preferably an alkylureido group containing 1 to 20 carbon atoms as the alkyl moiety or an arylureido group containing 6 to 20 carbon atoms as the aryl moiety), a sulfonamido group (preferably an alkylsulfonamido group containing 1 to 20 carbon atoms or an arylsulfonamido group containing 6 to 20 carbon atoms), a sulfamoyl group (preferably an alkylsulfamoyl group containing 1 to 20 carbon atoms or an arylsulfamoyl group containing 6 to 20 carbon atoms), a carbamoyl group (preferably an alkylcarbamoyl group containing 1 to 20 carbon atoms as the alkyl moiety or an arylcarbamoyl group containing 6 to 20 carbon atoms as the aryl moiety), an acyloxy group (preferably containing 1 to 20 carbon atoms), an amino group (including an unsubstituted amino group and preferably a secondary or tertiary amino group substituted with an alkyl group containing 1 to 20 carbon atoms or an aryl group containing 6 to 20 carbon atoms), a carbonic acid ester group (preferably an alkyl carbonic acid ester the alkyl moiety of which has from 1 to 20 carbon atoms or an aryl carbonic acid ester the aryl moiety of which has from 6 to 20 carbon atoms), a sulfone group (preferably an alkylsulfone group containing 1 to 20 carbon atoms or an arylsulfone group containing 6 to 20 carbon atoms), and a sulfinyl group (preferably an alkylsulfinyl group containing 1 to 20 carbon atoms or an arylsulfinyl group containing 6 to 20 carbon atoms).

The above described alkyl, alkenyl and aryl groups respectively include those which are further substituted with one or more of a wide variety of substituent groups as set forth above.

Further, the substituents $R^1$, $R^2$ and $R^3$ are selected depending upon the pH value and the composition of the processing solution to be used for processing the photographic element in which the precursor of the photographic agent according to the present invention is incorporated, and upon the time required for timing.

More specifically, the blocked photographic agent represented by the foregoing general formula (I) can be represented by the general formula (III):

(III)

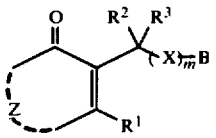

wherein B represents a photographic agent moiety which is bonded to X through a hetero atom contained in B; X represents a divalent linkage group which is bonded to a blocking moiety through a hetero atom contained in X; m is 0 or 1; $R^1$ represents a hydrogen atom, or a substituent group such as an alkyl group, an alkenyl group, an aryl group, an alkoxy group, an oxycarbonyl group, a carbamoyl group, an acyl group, a sulfonyl group, a sulfinyl group, a sulfamoyl group and so on; $R^2$ and $R^3$ each represents a hydrogen atom, an alkyl group, or an aryl group; and Z represents atoms necessary to form a carbocyclic ring or a heterocyclic ring (except for a heterocyclic ring which contains an >NH group at the position adjacent to the carbon atom to which $R^1$ is attached).

In addition to selection of pH of the processing solution, it becomes feasible to control the releasing speed of the photographic agent over a wide range by using a nucleophilic substance, especially sulfite ion, hydroxylamine, thiosulfate ion, metabisulfite ion or hydroxamic acid. Such nucleophilic substance is used in an amount of about $10^2$ to $10^6$ mole per mole of the precursor of a photographic agent for achieving the purpose.

Specific examples of the useful blocked photographic agents of the present invention are illustrated below. However, the present invention should not be construed as being limited to the following examples.

(1)

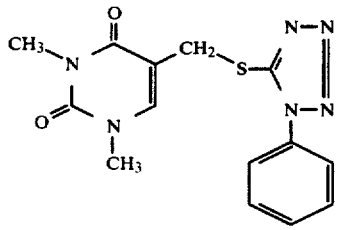

(2)

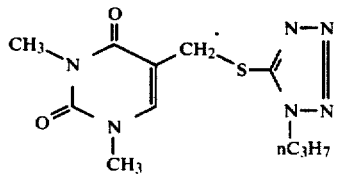

(3)

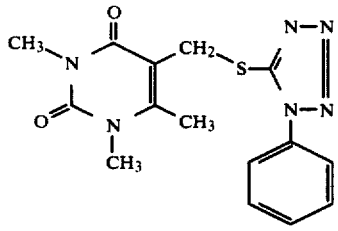

(4)

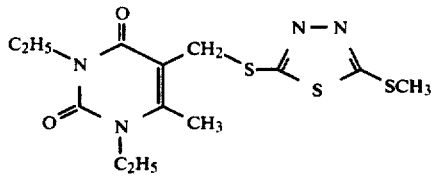

(5)

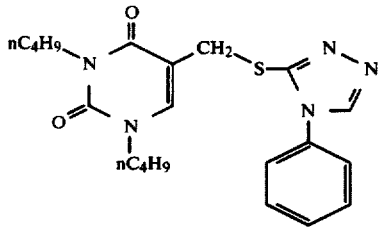

(6)

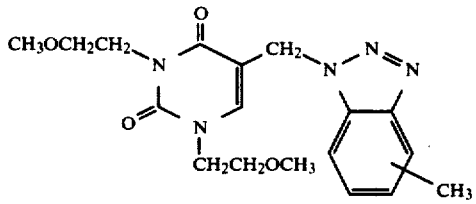

(7)

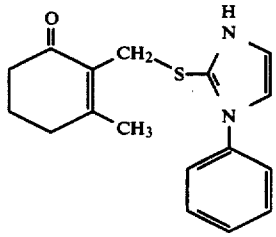

(8)

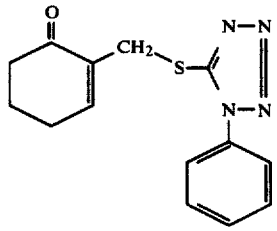

-continued
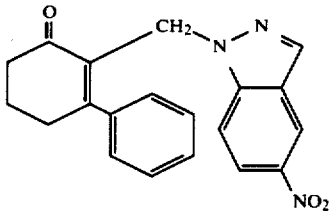
(9)
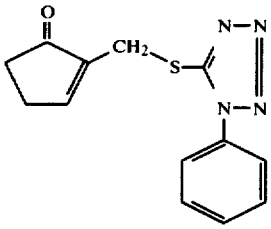
(10)
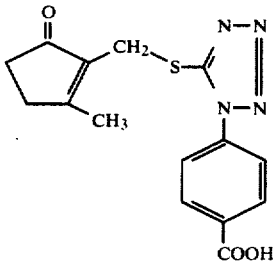
(11)
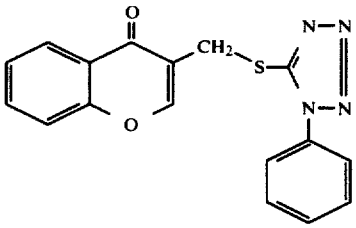
(12)
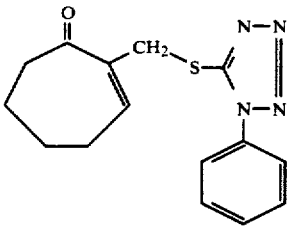
(13)
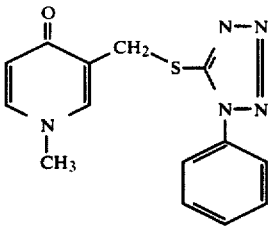
(14)
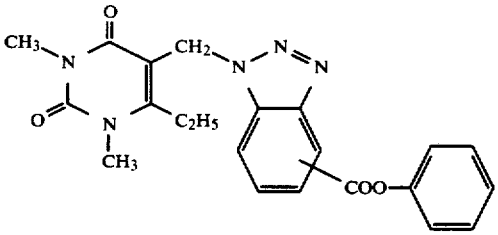
(15)
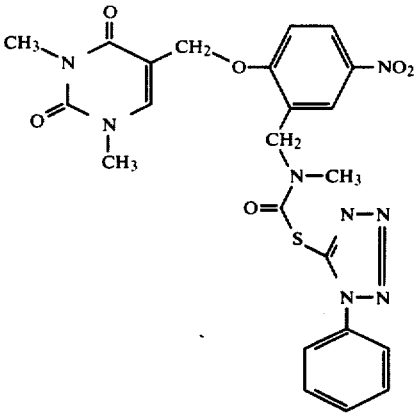
(16)
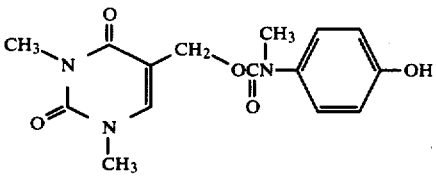
(17)
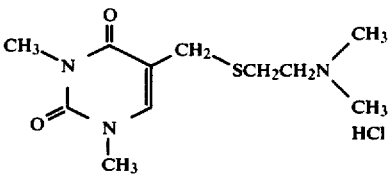
(18)
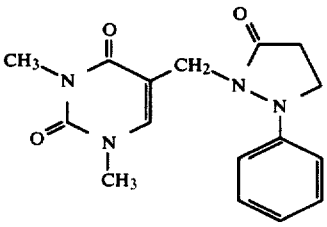
(19)
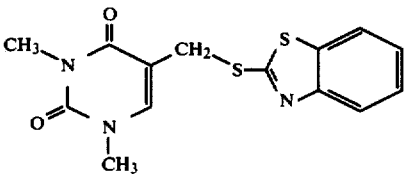
(20)

-continued
(21)
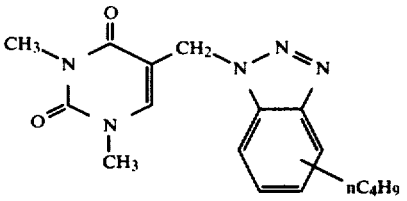
(22)
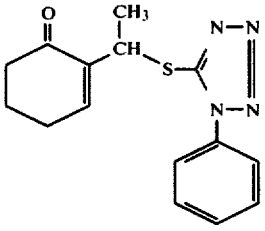
(23)
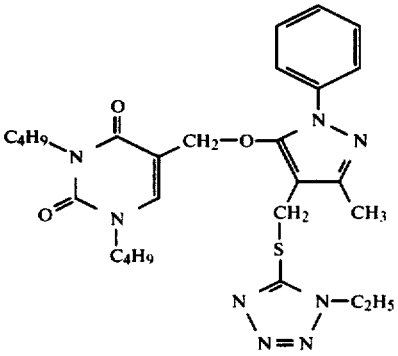
(24)
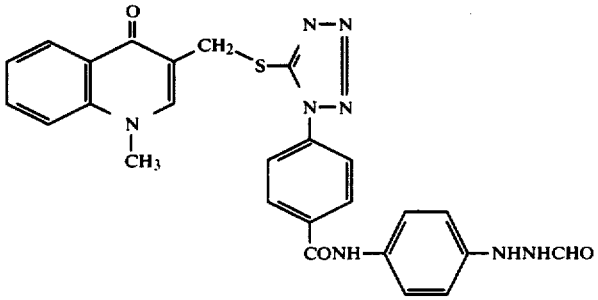
(25)
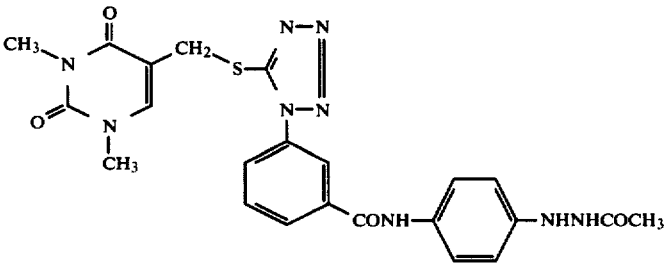
(26)
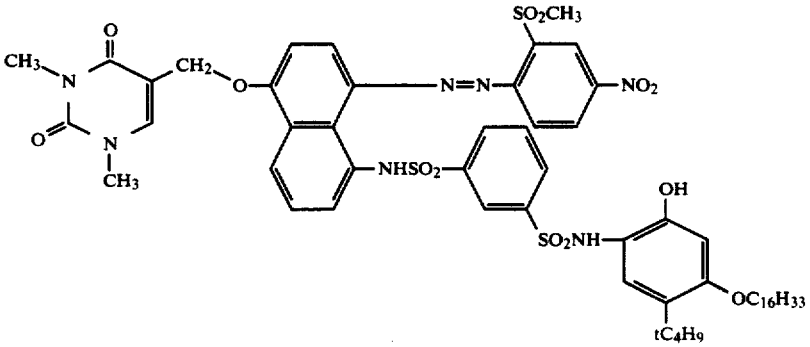

-continued

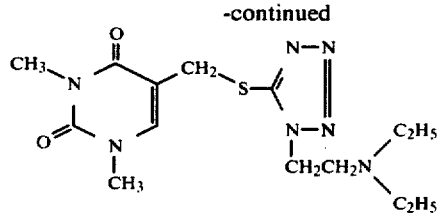

(27)

Typical synthesis examples of the blocked photographic agent to be employed in the present invention are illustrated below.

SYNTHESIS EXAMPLE 1

Synthesis of Compound (1)

To 21.3 g (0.150 mol) of 5-hydroxymethyluracil (prepared using the process described in *J. Heterocyclic Chem.*, Volume 21, page 9 (1984)) suspended in 100 ml of acetonitrile were added 48.3 g (0.350 mol) of anhydrous potassium carbonate and 49.8 g (0.350 mol) of methyl iodide. The mixture was refluxed by heating with vigorous stirring over a period of 30 hours. After cooling, the reaction mixture was filtered with suction, and the residue was washed with methanol. The filtrate and the washings were combined, and concentrated under reduced pressure to yield 16.1 g of 1,3-dimethyl-5-hydroxymethyluracil as white crystals. The yield was 63%.

To 30 ml of a solution containing 3.4 g portion (0.020 mol) of the thus prepared 1,3-dimethyl-5-hydroxymethyluracil in diethylene glycol dimethyl ether, 7.5 ml (0.10 mol) of thionyl chloride was added dropwise with stirring under cooling with ice. The mixture was warmed gradually to room temperature, and stirred over a period of 6 hours. Then, the reaction mixture was filtered with suction, and the excess thionyl chloride was distilled away from the filtrate under reduced pressure. To the liquid residue was added 4.0 g (0.020 mol) of sodium salt of 5-mercapto-1-phenyltetrazole (prepared from equimolar amounts of 5-mercapto-1-phenyltetrazole and sodium methylate) under room temperature. The mixture was stirred over a period of 10 hours. The reaction mixture was poured into ice-cold water, and extracted with chloroform. The organic phase was dried over anhydrous sodium sulfate and then concentrated. The residue was purified by passage through a chromatographic column of alumina using a chloroform-ethyl acetate mixture as developing solvent and, further, recrystallized from isopropanol to yield 3.2 g of Compound (1) as white crystals. Yield: 49%. Melting Point: 217° C. (decomposed).

| Elemental Analysis for $C_{14}H_{14}N_6O_2S$ | | | |
|---|---|---|---|
| | C | H | N |
| Calculated (%) | 50.90 | 4.27 | 25.44 |
| Found (%) | 50.04 | 4.09 | 25.55 |

SYNTHESIS EXAMPLE 2

Synthesis of Compound (20)

To 1,3-dimethyl-5-chloromethyluracil prepared from 3.4 g (0.02 mol) of 1,3-dimethyl-5-hydroxymethyluracil and 7.5 ml (0.1 mol) of thionyl chloride in the same manner as employed in synthesizing Compound (1) were added 3.2 g (0.02 mol) of 2-mercaptobenzothiazole and 8.2 g (0.1 mol) of sodium acetate, and the mixture was stirred for 10 hours. The reaction mixture was poured into ice-cold water, and extracted with chloroform.

The organic phase was dried over anhydrous sodium sulfate and then the solvent was distilled off. The residue was purified using alumina column chromatography and, further, recrystallized from isopropanol to yield 3.0 g of Compound (20). Yield: 51.0%. Melting Point: 250° C. or higher.

| Elemental Analysis for $C_{14}H_{13}N_3O_2S_2$ | | | |
|---|---|---|---|
| | C | H | N |
| Calculated (%) | 52.64 | 4.10 | 13.16 |
| Found (%) | 52.51 | 4.05 | 13.07 |

The precursors according to the present invention may be used in combination with two or more thereof.

The blocked photographic agents (precursors) of the present invention may be added to any constituent layers of a silver halide photographic material, including a silver halide emulsion layer, a coupler layer, a subbing layer, a protective layer, an interlayer, a filter layer, an antihalation layer, an image receiving layer, a cover sheet layer, and other auxiliary layers.

Incorporation of the precursors to be employed in the present invention into the above described layers can be carried out by adding them to coating compositions for forming the desired layers respectively as they are, or in a form of solutions prepared by dissolving in a solvent which does not adversely affect the photographic light-sensitive material, e.g., water, alcohol or the like, in appropriate concentrations. Also, the precursors can be first dissolved in high boiling point organic solvents and/or low boiling point organic solvents and further dispersed in water in the form of an emulsion and then added to the coating compositions. In addition, they may be added in such a state that they are loaded into polymer latexes using the methods as described in Japanese Patent Application (OPI) Nos. 39853/76, 59942/76 and 32552/79, U.S. Pat. No. 4,199,363 and so on.

The precursors may be added at any stage in the preparation of the photographic light-sensitive material. However, a preferable addition time is generally just before coating.

Suitable amounts of the blocked photographic agents of the present invention which can be employed depend on the kind of photographically useful agents released therefrom. Specifically, a suitable amount of an antifoggant or a development inhibitor ranges from $10^{-8}$ to $10^{-1}$ mol per mol of silver (more specifically, that of an antifoggant of the mercapto type ranges from $10^{-6}$ to $10^{-1}$ mol per mol of silver, and that of an antifoggant of the azole type, such as benzotriazole or the like, ranges from $10^{-5}$ to $10^{-1}$ mol per mol of silver); that of a developing agent ranges from $10^{-2}$ to 10 mols, preferably from 0.1 to 5 mols, per mol of silver; that of an auxiliary developing agent like a pyrazolidone ranges from $10^{-4}$ to 10 mols, preferably from $10^{-2}$ to 5 mols, per mol of silver; that of a fogging agent ranges from $10^{-2}$ to $10^{-6}$ mol, preferably from $10^{-3}$ to $10^{-5}$ mol, per mol of silver; that of a silver halide solvent, such as hypo or so on, ranges from $10^{-3}$ to 10 mols, preferably from $10^{-2}$ to 1 mol, per mol of silver; that of a bleach accelerator, such as an aminoethanethiol or so on, ranges from $10^{-5}$ to 0.1 mol, preferably from $10^{-4}$ to $10^{-2}$ mol, per mol of silver; and that of dyes or coloring agents for color diffusion transfer photographic materials, respectively, ranges from $10^{-3}$ to 1 mol, preferably from $5\times10^{-3}$ to 0.5 mol, per mol of silver.

The precursors of photographic agents to be employed in the present invention are completely stable under storage conditions and can release the photographic agent at a desired time upon processing due to their particular blocking moiety illustrated in the foregoing general formula (I).

Further, photographic light-sensitive materials containing the precursors of photographic agents in which the photographic moiety is an antifoggant or a development inhibitor and the blocking moiety is in accordance with the present invention have an advantage in that the screen range is long when dot images are formed and, therefore, they are especially suitable for photographic light-sensitive materials for plate making.

The compounds of the present invention can be employed in color photographic light-sensitive materials of, e.g., the incorporated coupler type system. Specific examples of color photographic materials include color photograph-taking negative films (for amateur use, motion picture use, etc.), color reversal films, color paper, color reversal paper, cinema positive films, and so on.

Also, the compounds of the present invention can be employed in the photographic system in which positive dye images are produced according to a silver dye bleach process, as described in T. H. James (editor), *The Theory of the Photographic Process*, 4th Ed., Chap. 12, pp. 363–366 (Title: Principles and Chemistry of Color Photography IV. Silver Dye Bleach Process), Macmillan, New York (1977), and so on.

Moreover, the compounds of the present invention can be employed in black-and-white photographic materials. Specific examples of black-and-white photographic materials include direct medical X-ray films, black-and-white films for amateur use, lith films, scanner films, and so on.

In these color photographic materials and black-and-white photographic materials, the compounds of the present invention can be incorporated in any constituent layers thereof, including an emulsion layer, an interlayer, a surface protective layer and so on.

When the compounds of the present invention are applied to the color diffusion transfer process, the silver halide photographic material of the present invention can have a film unit structure of the peel-apart type; that of the integrated type as described in Japanese Patent Publication Nos. 16356/71 and 33697/73, Japanese Patent Application (OPI) No. 13040/75, and British Pat. No. 1,330,524; or that of the no peel-apart type as described in Japanese Patent Application (OPI) No. 119345/82. The precursors represented by the foregoing general formula (I) may be added to any layer of the film unit, provided that they are associated with silver halide emulsions so as to act effectively upon development of the silver halide emulsions. However, it is preferable to add them to a light-sensitive layer such as a light-sensitive silver halide emulsion-containing layer, a dye image providing compound-containing layer or other auxiliary layers; a subsidiary layer such as an image receiving layer or a white reflecting layer; or a neutralizing structure such as a neutralizing layer, a neutralization timing layer or the like. Of these layers, the neutralizing layer or the neutralization timing layer is especially desirable for addition.

It is advantageous to use gelatin as a binder or a protective colloid of emulsion layers and interlayers to constitute the photographic material of the present invention. Of course, other hydrophilic colloids can also be used alone or as combinations with gelatin.

In the present invention, gelatin may be either lime-processed one or acid-processed one. Details of the preparation of gelatin are described in Arthur Veis, *The Macromolecular Chemistry of Gelatin*, Academic Press (1964).

To the photographic emulsions to be used in the present invention, surface active agents may be added alone or as a combination of two or more thereof.

They are, in general, used as coating aids, and occasionally for other purposes, for instance, emulsifying dispersion, improvements in photographic characteristics concerning sensitization, prevention of generation of static charges, prevention of adhesion and so on. Examples of useful surface active agents include natural surface active agents such as saponin, etc.; nonionic surface active agents such as those of alkylene oxide type, those of glycerol type, those of glycidol type, etc.; cationic surface active agents such as higher alkyl amines, quaternary ammonium salts, pyridines and other heterocyclic compounds, phosphoniums, sulfoniums, etc.; anionic surface active agents containing an acidic group such as a carboxylic acid group, a sulfonic acid group, a phosphoric acid group, a sulfate group, a phosphate group, etc.; and amphoteric surface active agents such as amino acids, aminosulfonic acids, sulfates or phosphates of aminoalcohols, etc.

Suitable examples of polyalkylene oxide compounds which can be used in the present invention include products obtained by condensation reaction of polyalkylene oxides containing at least 10 units of alkylene oxide having 2 to 4 carbon atoms, for example, ethylene oxide, propylene-1,3-oxide, butylene-1,2-oxide, etc., especially ethylene oxide, with compounds having at least one active hydrogen atom, for example, water, aliphatic alcohols, aromatic alcohols, fatty acids, organic amines, hexitol derivatives, etc.; and block copolymers of two or more kinds of polyalkylene oxides. More specifically, polyalkylene glycols, polyalkylene glycol alkyl ethers, polyalkylene glycol aryl ethers, polyalkylene glycol (alkyl aryl) esters, polyalkylene glycol esters, polyalkylene glycol fatty acids amides, polyalkylene glycol amines, polyalkylene glycol block copolymers, polyalkylene glycol graft copolymers and so on can be used as such polyalkylene oxide compounds. Molecular weights of these polyalkylene oxide compounds must be at least 600.

Two or more polyalkylene oxide chains may be contained in a molecule. Therein, each polyalkylene oxide chain may be composed of less than 10 alkylene oxide units, but the total alkylene oxide units in a molecule should be at least 10. Where two or more polyalkylene oxide chains are contained in a molecule, they may be composed of different alkylene oxide units, for example, ethylene oxide and propylene oxide. Polyalkylene oxide compounds which can be preferably used in the present invention are those containing from 14 to 100 alkylene oxide units.

Specific examples of polyalkylene oxide compounds which can be used in the present invention are set forth below.

$HO(CH_2CH_2O)_{90}H$ P-1

$C_4H_9O(CH_2CH_2O)_{15}H$ P-2

$C_{12}H_{25}O(CH_2CH_2O)_{15}H$ P-3

$C_{18}H_{37}O(CH_2CH_2O)_{15}H$ P-4

$C_{18}H_{37}O(CH_2CH_2O)_{40}H$ P-5

$C_8H_{17}CH{=}CHC_8H_{16}O(CH_2CH_2O)_{15}H$ P-6

P-7

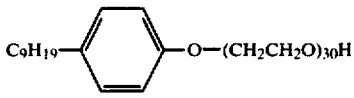

P-8

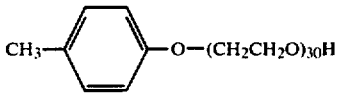

P-9

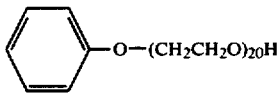

$C_{11}H_{23}COO(CH_2CH_2O)_{30}H$ P-10

$C_{11}H_{23}COO(CH_2CH_2O)_{24}OCC_{11}H_{23}$ P-11

P-12

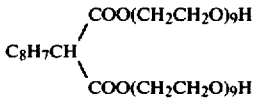

$C_{11}H_{23}CONH(CH_2CH_2O)_{15}H$ P-13

P-14

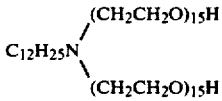

$C_{14}H_{29}N(CH_2)(CH_2CH_2O)_{24}H$ P-15

P-16

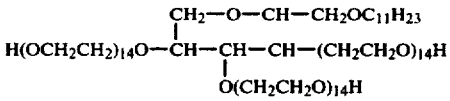

P-17

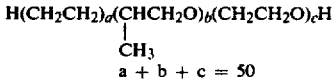

a + b + c = 50 b:a + c = 10:9

P-18

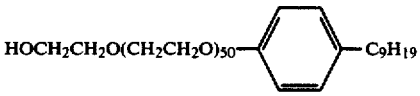

P-19

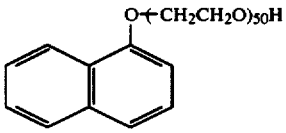

P-20

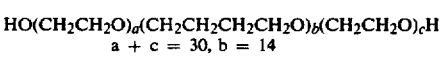

a + c = 30, b = 14

-continued

P-21

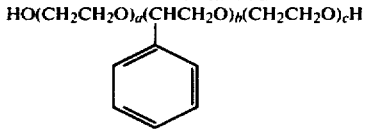

b = 8, a + c = 50

P-22

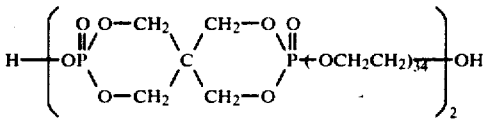

P-23

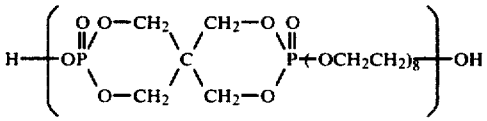

P-24

The polyalkylene oxide compounds illustrated above are described in Japanese Patent Application (OPI) Nos. 156423/75, 108130/77 and 3217/78. These polyalkylene oxide compounds may be used alone or in a mixture of two or more thereof.

These polyalkylene oxide compounds can be added to silver halide emulsions in the form of a solution prepared by dissolving them in water or a low boiling point organic solvent compatible with water in proper concentrations at an appropriate stage of emulsion-making prior to coating, preferably after the chemical ripening thereof. The polyalkylene oxide compounds which can be used in the present invention are added in an amount ranging preferably from $1\times10^{-5}$ to $1\times10^{-2}$ mol per mol of silver halide.

Silver halides which can be used in photographic emulsion layers to constitute the photographic light-sensitive material of the present invention include silver bromide, silver iodobromide, silver iodochlorobromide, silver chlorobromide and silver chloride. Of these silver halides, silver iodobromide having an iodide content of 15 mol% or less is preferred over others. Especially good results can be obtained when an iodide content of the silver iodobromide ranges from 2 to 12 mol%.

The present invention is not particularly restricted as to mean grain size of silver halide grains in the photographic emulsion layers. (The grain size herein refers to the grain diameter when the grains are spherical or approximately spherical in shape, while it refers to the edge length when the grains are cubic in shape. In both cases, it is represented by the mean based on the projected areas of grains.) However, it is preferably 3 μm or less.

The distribution of the grain size can be either narrow or broad.

The silver halide grains in the photographic emulsions may have a regular crystal form, such as that of a cube, an octahedron or so on; an irregular crystal form, such as that of a sphere, a tabular form or so on; or a composite form thereof. A mixture of various crystal forms of silver halide grains may also be present.

Photographic emulsions in which silver halide grains having such a supertabular shape that the grain diameter is not less than five times the grain thickness are contained in a fraction of 50% or more, based on the total projected area of all grains present therein, may be employed in the present invention.

The interior and the surface of the silver halide grains may differ, and either silver halide grains of the kind which form a latent image predominantly at the surface of the grains, or grains of the kind which mainly form a latent image inside the grains may be used.

The photographic emulsions employed in the present invention can be prepared using various methods, as described in, for example, P. Glafkides, *Chimie et Physique Photographique,* Paul Montel, Paris (1967), G. F. Duffin, *Photographic Emulsion Chemistry,* The Focal Press, London (1966), V. L. Zelikman et al, *Making and Coating Photographic Emulsion,* The Focal Press, London (1964), and so on. More specifically, the acid process, the neutral process, the ammonia process and so on can be employed. Suitable methods for reacting a water-soluble silver salt with a water-soluble halide include, for example, a single jet method, a double jet method or a combination thereof.

Also, a method in which silver halide grains are produced in the presence of excess silver ion (the so-called reversal mixing method) can be employed in the present invention. Further, the so-called controlled double jet method, in which the pAg of the liquid phase wherein silver halide grains are to be precipitated is maintained constant, may also be employed in the present invention. According to this method, silver halide emulsions having a regular crystal form and an almost uniform grain size can be obtained.

Two or more of silver halide emulsions prepared separately may be used in a form of mixture thereof.

In a process of producing silver halide grains or allowing the produced silver halide grains to ripen physically, cadmium salts, zinc salts, lead salts, thallium salts, iridium salts or complexes thereof, rhodium salts or complexes thereof, iron salts or complexes thereof and/or the like may be present.

It is usual for the silver halide emulsion of the present invention to be chemically sensitized. Chemical sensitization can be carried out using processes described in H. Frieser (editor), *Die Grundlagen der photographischen Prozesse mit Silberhalogeniden,* pp. 675 to 734, Akademische Verlagsgesellschaft (1968), and so on.

More specifically, sulfur sensitization using active gelatin or compounds containing sulfur capable of reacting with silver ion (e.g., thiosulfates, thioureas, mercapto compounds, rhodamines and so on), reduction sensitization using reducing materials (e.g., stannous salts, amines, hydrazine derivatives, formamidine sulfinic acid, silane compounds and so on), noble metal sensitization using noble metal compounds (e.g., gold metal complexes, and Group VIII metal complexes such as those of platinum, iridium, palladium, etc.), and so on can be employed individually or as a combination thereof.

The photographic emulsion of the present invention can contain a wide variety of compounds for purposes of preventing fog or stabilizing photographic functions during production, storage, or photographic processing. Specifically, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole) and so on; mercaptopyrimidines; mercaptotriazines; thioketo compounds like oxazolidinethiones; azaindenes such as triazaindenes, tetraazaindenes (especially 4-hydroxy-substituted (1,3,3a,7)tetraazaindenes), pentaazaindenes and so on; and compounds which have been known as antifoggants or stabilizers, such as benzenethiosulfonic acid, benzenesulfinic acid, benzenesulfonic acid amide, and so on can be added to the silver halide emulsions.

Photographic emulsions of the photographic light-sensitive material to be used in the present invention may further contain, for example, thioether compounds, thiomorpholines, quaternary ammonium salt compounds, urethane derivatives, urea derivatives, imidazole derivatives, 3-pyrazolidones and so on in order to increase the sensitivity and contrast, or in order to accelerate the developing rate thereof.

Furthermore, the photographic light-sensitive material of the present invention can contain a dispersion of water-insoluble or slightly soluble polymers in photographic emulsion layers or other hydrophilic colloid layers for the purpose of improvements in dimensional stability and so on. Suitable examples of such polymers include homopolymers or copolymers in which alkyl(meth)acrylates, alkoxyalkyl(meth)acrylates, glycidyl(meth)acrylates, (meth)acrylamides, vinyl esters (e.g., vinyl acetate), acrylonitrile, olefins, styrenes and so on are contained alone or in combinations of two or more as constitutional repeating units, and copolymers which contain a combination of one or more of the monomers set forth above and one or more of other monomers, such as acrylic acid, methacrylic acids, $\alpha,\beta$-unsaturated dicarboxylic acids, hydroxyalkyl(meth)acrylates, a sulfoalkyl(meth)acrylate, styrenesulfonic acid and so on, as constitutional repeating units.

The photographic emulsions to be used in the present invention may be spectrally sensitized using methine dyes or other dyes. Specific spectral sensitizing dyes which can be employed include cyanine dyes, merocyanine dyes, complex cyanine dyes, complex merocyanine dyes, holopolar cyanine dyes, hemicyanine dyes, styryl dyes and hemioxonal dyes. Especially useful dyes are cyanine dyes, merocyanine dyes and complex merocyanine dyes. Any nuclei usually present in cyanine dyes can be the basic heterocyclic nuclei of these dyes. More specifically, bacic heterocyclic nuclei include pyrroline, oxazoline, thiazoline, pyrrole, oxazole, thiazole, selenazole, imiazole, tetrazole, pyridine and like nuclei; nuclei formed by fusing together one of the above described nuclei and an alicyclic hydrocarbon ring; and nuclei formed by fusing together one of the above described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline and like nuclei. Each of these nuclei may be substituted on its carbon atom.

The merocyanine dyes or the complex merocyanine dyes can contain 5- or 6-membered heterocyclic nuclei, such as pyrazolin-5-one, thiohydantoin, 2-thiooxazolidin-2,4-dione, thiazolidin-2,4-dione, rhodanine, thiobarbituric acid and like nuclei, as ketomethylene structure-containing nuclei.

These sensitizing dyes may be employed individually or in combination. Combinations of sensitizing dyes are often employed for the purpose of supersensitization.

Substances which can exhibit a supersensitizing effect in combination with a certain sensitizing dye although they themselves do not spectrally sensitize silver halide emulsions or do not absorb light in the visible region may be incorporated into the silver halide emulsions. For example, aminostilbene compounds substituted with nitrogen-containing heterocyclic groups (for instance, as described in U.S. Pat. Nos. 2,933,390 and 3,635,721), aromatic organic acid-formaldehyde condensates (for instance, as described in U.S. Pat. No. 3,743,510), cadmium salts, azaindene compounds and so on can be employed.

The present invention can also be applied to a multilayer multicolor photographic material having at least two photographic emulsion layers having different color sensitivities on a support. A multilayer color photographic material has, in general, at least one red-sensitive emulsion layer, at least one green-sensitive emulsion layer, and at least one blue-sensitive emulsion layer on a support. The order of these layers can be varied as desired. Usually cyan-, magenta-, and yellow-forming couplers are incorporated in red-, green-, and blue-sensitive emulsion layers, respectively. However, different combinations can be employed, if desired.

In addition to the foregoing compounds of the present invention, color forming couplers, that is to say, compounds capable of forming colors by coupling with the oxidation product of aromatic primary amine developing agents (e.g., phenylenediamine derivatives, aminophenol derivatives, etc.) upon color development processing, can be incorporated in the same or different photographic emulsion layers, or light-insensitive layers of the photographic light-sensitive material produced in accordance with the present invention. Specific examples of magenta couplers which can be used include 5-pyrazolone couplers, pyrazolobenzimidazole couplers, pyrazoloimidazole couplers, pyrazolopyrazole couplers, pyrazolotriazole couplers, pyrazolotetrazole couplers, cyanoacetylcumarone couplers, open chain acylacetronitrile couplers, and so on. Specific examples of yellow couplers which can be used include acylacetamide couplers (e.g., benzoylacetanilides, pivaloylacetanilides, etc.), and so on. Specific examples of cyan couplers which can be used include naphthol couplers, phenol couplers, and so on. Of these couplers, nondiffusible couplers which contain a hydrophobic group as a so-called ballast group in a molecule and polymerized couplers are more advantageous. The couplers may be either 4-equivalent or 2-equivalent with respect to silver ion. In addition, the couplers may be colored couplers having a color correcting effect, and couplers capable of releasing development inhibitors upon development (so-called DIR couplers). Besides DIR couplers, colorless DIR coupling compounds which form colorless products upon the coupling reaction and release development inhibitors can also be incorporated.

Two or more of the above described couplers and the like can be incorporated into the same layer, or the same compound can also be incorporated into two or more different layers to achieve the characteristics required of the photographic material.

The compounds of the present invention and couplers which can be used in combination therewith in the present invention can be introduced into silver halide emulsion layers using known methods as described in, e.g., U.S. Pat. No. 2,322,027. Specifically, they are dissolved in high boiling point organic solvents, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethylsuccinate, diethyl azelate, etc.), trimesic acid esters (e.g., tributyl teimesate, etc.) and so on, or in low boiling point organic solvents having boiling points ranging from about 30° C. to about 150° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate and so on and then dispersed into hydrophilic colloids. The above described high boiling point organic solvents and low boiling point organic solvents may be employed in a form of mixture of two or more thereof.

In addition, the compounds of the present invention and the couplers can be dispersed into hydrophilic colloids using polymers described in Japanese Patent Publication No. 39853/76, and Japanese Patent Application (OPI) No. 59943/76.

When the couplers contain acidic groups such as carboxylic acid, sulfonic acid and the like, the couplers are introduced into hydrophilic colloids as alkaline aqueous solutions.

The photographic emulsion layers or other hydrophilic colloid layers which constitute the photographic material of the present invention may contain inorganic or organic hardeners. Examples of hardeners which can be used include chromium salts (e.g., chrome alum, chromium acetate, etc.), aldehyde compounds (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonylmethyl-2-propanol, etc.), active halogen-containing compounds (e.g., 2,4-dichloro-6-hydroxy-s-triazine, etc.), halogeno carboxyaldehydes (such as mucochloric acid, mucophenoxychloric acid, etc.), and so on. These hardeners may be used alone or as a combination of two or more thereof.

When dyes, ultraviolet absorbing agents and the like are contained in hydrophilic colloid layers of the photographic material prepared in accordance with the present invention, they may be fixed inside the hydrophilic colloid layers using a mordant like a cationic polymer and so on.

The photographic material prepared in accordance with the present invention may contain as a color fog inhibitor a hydroquinone derivative, an aminophenol derivative, a gallic acid derivative, an ascorbic acid derivative and so on.

Hydrophilic colloid layers of the photographic material prepared in accordance with the present invention may contain an ultraviolet absorbing agent. For example, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamate compounds (e.g., those described in U.S. Pat. Nos. 3,705,805 and 3,707,375), butadiene compounds (e.g., those described in U.S. Pat. No. 4,045,229) and benzoxazole compounds (e.g., those described in U.S. Pat. No. 3,700,455) can be used as ultraviolet absorbing agents. Also, ultraviolet absorbing couplers (e.g., cyan dye forming couplers of the α-naphthol type) and ultraviolet absorbing polymers may be used. These ultraviolet absorbing agents may be mordanted inside a particular layer.

The photographic material prepared in accordance with the present invention may contain water-soluble dyes as filter dyes, antihalation dyes or dyes for various other purposes in its hydrophilic colloid layers. Examples of dyes useful for the above described purposes include oxonol dyes, hemioxonol dyes, styryl dyes, merocyanine dyes, cyanine dyes, and azo dyes. Of these dyes, oxonol dyes, hemioxonol dyes, and merocyanine dyes are used to a greater advantage.

In the present invention, known discoloration inhibitors can be used. Color image stabilizers which can be used in the present invention can be used alone or in combinations of two or more thereof. Specific examples of known discoloration inhibitors include hydroquinone derivatives, gallic acid derivatives, p-alkoxyphenols, p-oxyphenol derivatives, and bisphenols.

The present invention is not particularly restricted as to the developing method for the silver halide photographic material, and known processing methods and known processing solutions, as described, e.g., in *Research Disclosure*, Vol. 176, pp. 28–30, can be employed in the present invention. This photographic processing may be either a photographic processing for forming a silver image (black-and-white processing) or a photographic processing for forming a dye image (color photographic processing), depending upon the end-use purpose of the photographic material. The processing temperature is generally in the range of about 18° C. to about 50° C. Of course, temperatures lower than about 18° C. or higher than about 50° C. may be employed.

Dye images can be formed using conventional methods. For instance, a negative-positive process (as described in *Journal of the Society of Motion Picture and Television Engineers*, Vol. 61, pp. 667–701 (1953)); a color reversal process in which a negative silver image is formed by development with a developing solution containing a black-and-white developing agent, uniform exposure or another appropriate fogging treatment is then carried out at least once, and subsequently color development is carried out to provide a positive dye image; a silver dye bleach process in which dye-containing photographic emulsion layers are developed after exposure to produce a silver image, and the dyes are bleached using the resulting silver image as a bleaching catalyst; and so on can be employed.

A color developing solution is, in general, an alkaline aqueous solution containing a color developing agent. Suitable examples of color developing agents which can be used include known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the color developing agents set forth above, those described in L. F. A. Mason, *Photographic Processing Chemistry*, pp. 226–229, The Focal Press, London (1966), U.S. Pat. Nos. 2,193,015 and 2,592,364, Japanese Patent Application (OPI) No. 64933/73, and so on, may be also employed.

Besides color developing agents as described above, the color developing solution can contain a pH buffering agent such as sulfites, carbonates, borates and phosphates of alkali metals, a development inhibitor or an antifoggant such as bromides, iodides and organic antifoggants, and so on. Optionally, a water softener, a preservative such as hydroxylamines, etc., an organic solvent such as benzyl alcohol, diethylene glycol, etc., a development accelerator such as polyethylene glycols, quaternary ammonium salts, amines, etc., dye forming couplers, competing couplers, a fogging agent such as sodium borohydride, etc., an auxiliary developer such as 1-phenyl-3-pyrazolidone, etc., a viscosity imparting agent, chelating agents of polycarboxylic acid type, an antioxidant, and so on, may be contained in the color developing solution.

The photographic emulsion layers which have been color development-processed are generally subjected to a bleach processing. The bleach processing may be carried out either simultaneously with or separately from a fix processing. Suitable examples of bleaching agents which can be used include compounds of polyvalent metals such as iron (III), cobalt (III), chromium (VI), copper (II), etc., peroxy acids, quinones, nitroso compounds, and so on.

More specifically, ferricyanides, dichromates, organic complex salts of Fe (III) or Co (III) such as complex salts of aminopolycarboxylic acids, e.g., ethylenediaminetetraacetic acid, nitrilotriacetic acid, 1,3-diamino-2-propanoltetraacetic acid, etc., or organic acids, e.g., citric acid, tartaric acid, malic acid, etc., persulfates, permanganates, nitrosophenol, and so on, can be employed as bleaching agents. Of these compounds, potassium ferricyanide, sodium ethylenediaminetetraacetato ferrate (III), and ammonium ethylenediaminetetraacetato ferrate (III) are especially useful. In particular, (ethylenediaminetetraacetato)iron (III) complexes are used to advantage in both an independent bleaching bath and a combined bleaching and fixing bath.

A fixing bath which can be used in the present invention includes those having generally used compositions. Therein, not only thiosulfates and thiocyanates but also organic sulfur compounds which are known to have a fixing effect can be used as fixing agents. In the fixing solution, water-soluble aluminum salts may be contained as hardeners.

The developing solution employed for black-and-white photographic processing can contain known developing agents. Suitable developing agents include dihydroxybenzenes (e.g., hydroquinone), 3-pyrazolidones (e.g., 1-phenyl-3-pyrazolidone), aminophenols (e.g., N-methyl-p-aminophenol), etc., and they can be used alone or in combination. The developing solution can generally contain, in addition to the above described developing agents, known preservatives, alkali agents, pH buffering agents and antifoggants and optionally may contain dissolving aids, color toning agents, development accelerators, surface active agents, defoaming agents, water softeners, hardeners, viscosity imparting agents and so on.

The photographic emulsions of the present invention can also be subjected to the so-called "lithographic" development processing, if desired. "Lithographic" development processing is the processing in which in order to effect the photographic reproduction of line images or the photographic reproduction of halftone images by means of dots, dihydroxybenzenes are generally used as developing agents and the development step is made to proceed infectiously under the condition that a sulfite ion concentration is maintained at a low level (the details of which are described in L. F. A.

Mason, *Photographic Processing Chemistry*, pp. 163–165 (1966)).

The present invention is illustrated in greater detail by reference to the following examples, but it should not be construed as being limited to these examples.

Unless otherwise specified, all percents, ratios, etc., are by weight.

EXAMPLE 1

In order to evaluate the effectiveness of the photographic agents which were blocked in accordance with the present invention, Samples A to H were prepared in the manner described below, in which the compounds of the present invention and the comparison compounds corresponding thereto were employed, respectively. One of the antifoggants set forth in Table 1 or one of the blocked photographic agents (precursors) of the present invention set forth also in Table 1 was dissolved in tricresyl phosphate together with Coupler Cp-1, emulsified, and added to a silver halide emulsion. The resulting emulsion was coated on a cellulose triacetate support having a subbing layer. The coverage of each ingredient was expressed in terms of $g/m^2$ or $mol/m^2$, and designated in parentheses.

(1) Emulsion Layer

Negative type silver iodobromide emulsion having a grain size of 1.4 μm (silver: $1.6\times10^{-2}$ $mol/m^2$)

Magenta Coupler Cp-1 ($1.33\times10^{-3}$ $mol/m^2$)

Antifoggant or precursor compound of the present invention (as shown in Table 1)

Gelatin (2.50 $g/m^2$)

(2) Protective Layer

Gelatin (1.30 $g/m^2$)

Sodium 2,4-dichloro-6-hydroxy-s-triazine (0.05 $g/m^2$)

These films were allowed to stand for 14 hours under conditions of 40° C. and 70% RH. Thereafter, they were subjected to imagewise exposure for sensitometry and then to the following color development processing.

| Steps for Color Development Processing | Time | Temperature |
|---|---|---|
| 1. Color Development | 3 min 15 sec | 38° C. |
| 2. Bleaching | 6 min 30 sec | " |
| 3. Washing | 2 min | " |
| 4. Fixing | 4 min | " |
| 5. Washing | 4 min | " |
| 6. Stabilizing | 1 min | " |

Compositions of the processing solutions employed in the above described steps, respectively, are described below.

| | |
|---|---|
| Color Developing Solution | |
| Water | 800 ml |
| 4-(N—ethyl-N—hydroxyethyl)amino-2-methylaniline Sulfate | 5 g |
| Sodium Sulfite | 5 g |
| Hydroxylamine Sulfate | 2 g |
| Potassium Carbonate | 30 g |
| Potassium Hydrogencarbonate | 1.2 g |
| Potassium Bromide | 1.2 g |
| Sodium Chloride | 0.2 g |
| Trisodium Nitrilotriacetate | 1.2 g |
| Water to make | 1 liter (pH = 10.1) |
| Bleaching Solution | |
| Water | 800 ml |
| Ammonium Ethylenediaminetetraacetato Ferrate (III) | 100 g |

-continued

| | |
|---|---|
| Disodium Ethylenediaminetetraacetate | 10 g |
| Potassium Bromide | 150 g |
| Acetic Acid | 10 g |
| Water to make | 1 liter (pH = 6.0) |
| Fixing Solution | |
| Water | 800 ml |
| Ammonium Thiosulfate | 150 g |
| Sodium Sulfite | 10 g |
| Sodium Hydrogensulfite | 2.5 g |
| Water to make | 1 liter (pH = 6.0) |
| Stabilizing Solution | |
| Water | 800 ml |
| Formaldehyde (37% aq. soln.) | 5 ml |
| Polyoxyethylene p-Monononylphenyl Ether | 0.2 g |
| Water to make | 1 liter |

The photographic properties thus obtained are shown in Table 1.

The coupler and the antifoggants for comparison employed in the above described samples are illustrated below.

Cp-1

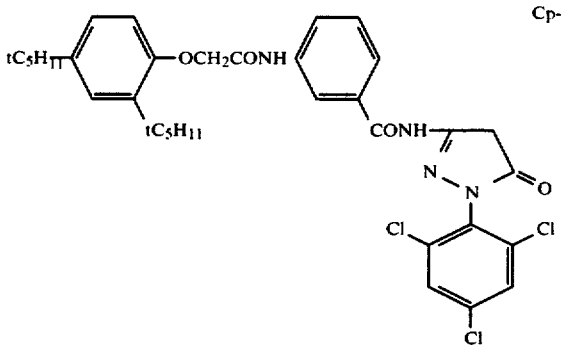

A-1

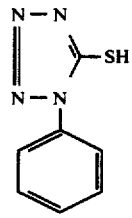

A-2

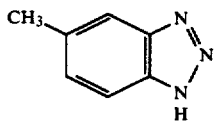

A-3

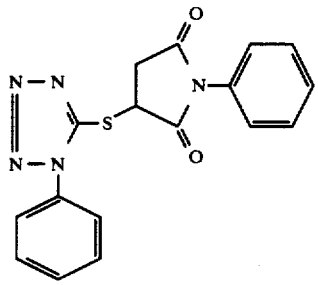

(Precursor described in U.S. Pat. No. 3,888,677)

-continued

A-4

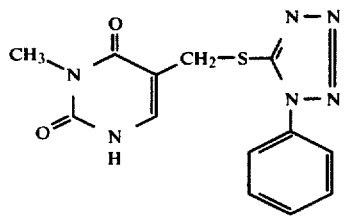

(Precursor described in U.S. Pat. No. 4,350,754)

TABLE 1

| Sample | Precursor Compound of the Present Invention or Comparison Antifoggants | Amount Added (mol/m²) | Fog | Gamma | Relative* Sensitivity | Maximum Color Density |
|---|---|---|---|---|---|---|
| A (Control) | Absent | — | 0.12 | 0.82 | 100 | 1.65 |
| B (Invention) | (1) | $1.1 \times 10^{-5}$ | 0.07 | 0.75 | 95 | 1.51 |
| C (Invention) | (3) | $1.1 \times 10^{-5}$ | 0.06 | 0.76 | 96 | 1.50 |
| D (Invention) | (6) | $2.2 \times 10^{-4}$ | 0.07 | 0.83 | 99 | 1.63 |
| E (Comparison) | A-1 | $2.2 \times 10^{-6}$ | 0.05 | 0.43 | 28 | 0.93 |
| F (Comparison) | A-2 | $2.2 \times 10^{-5}$ | 0.07 | 0.61 | 52 | 1.32 |
| G (Comparison) | A-3 | $1.1 \times 10^{-5}$ | 0.07 | 0.74 | 75 | 1.25 |
| H (Comparison) | A-4 | $1.1 \times 10^{-5}$ | 0.07 | 0.71 | 70 | 1.20 |

*Relative Sensitivity: Relative sensitivity is shown by a reciprocal of an exposure amount required for obtaining a color density of fog + 0.2 and with the sensitivity of Control Sample A as 100.

As can be seen from the results shown in Table 1, in Samples B to D which contained the compounds of the present invention, generation of fog was depressed and the gamma, the sensitivity and the maximum color density were not much decreased.

EXAMPLE 2

Sample B (present invention) and Samples G and H (containing the precursors for comparison, respectively) as described in Example 1 were stored for 1 week under the conditions of 40° C. and 80% RH and then subjected to the imagewise exposure and development processing in the same manner as Example 1. As the result of these processings, Samples G and H showed the remarkably low values of gamma, sensitivity and maximum color density compared with Sample B. Accordingly, it has turned out that the precursor of the present invention has a good storage stability, while the precursors used in Samples G and H lack good stability because of a tendency for the blocking moiety to come off upon storage.

EXAMPLE 3

To an aqueous solution containing 70 g of gelatin were simultaneously added at a constant rate an aqueous solution containing 1 kg of silver nitrate and an aqueous solution containing 210 g of potassium bromide and 290 g of sodium chloride over a period of 30 minutes. After removal of the soluble salts, gelatin was added to the emulsion. The resulting emulsion was subjected to gold sensitization and sulfur sensitization to obtain a silver chlorobromide emulsion (grain size: 0.27 μm, bromide content: 30 mol%). To the emulsion was added 4-hydroxy-6-methyl-1,3,3a,7-tetraazaindene as stabilizer.

Further, the blocked photographic agent (precursor) of the present invention, as set forth in Table 2 below, was added thereto. Subsequently, to the emulsion were added sodium 1-hydroxy-3,5-dichlorotriazine as hardener and sodium dodecylbenzenesulfonate as a coating aid. The thus prepared emulsion was coated on a polyethylene terephthalate film at a silver coverage of 4.2 g/m².

The film samples thus produced were exposed wedgewise using a xenon flash lamp for $10^{-5}$ second, and developed with the developing solution shown below at 27° C. for 4 minutes, followed by stopping, fixing, washing and drying. The densities of the thus processed samples were measured using a P-type densitometer (produced by Fuji Photo Film Co., Ltd.), and the sensitivity and fog values were measured. The standard point of optical density for determining the sensitivity was a point of fog+0.5. The results obtained are shown in Table 2.

| Composition of the Developing Solution | |
|---|---|
| p-Methylaminophenol Sulfate | 0.31 g |
| Anhydrous Sodium Sulfite | 39.6 g |
| Hydroquinone | 6.0 g |
| Anhydrous Sodium Carbonate | 18.7 g |
| Potassium Bromide | 0.86 g |
| Citric Acid | 0.68 g |
| Potassium Metahydrogen Sulfite | 1.5 g |
| Water to make | 1 liter |

TABLE 2

| Sample | Precursor | Amount Added (mol/kg emulsion) | Fog | Relative Sensitivity |
|---|---|---|---|---|
| 1 (Control) | — | — | 0.07 | 100 (Standard) |
| 2 (Invention) | (1) | $3.0 \times 10^{-4}$ | 0.05 | 94 |
| 3 (Invention) | (3) | $3.0 \times 10^{-4}$ | 0.04 | 93 |
| 4 (Invention) | (8) | $3.0 \times 10^{-4}$ | 0.05 | 96 |
| 5 (Invention) | (10) | $3.0 \times 10^{-4}$ | 0.05 | 95 |
| 6 | A-1 | $3.0 \times 10^{-4}$ | 0.05 | 47 |

TABLE 2-continued

| Sample | Precursor | Amount Added (mol/kg emulsion) | Fog | Relative Sensitivity |
|---|---|---|---|---|
| (Comparison) | | | | |

Comparison Compound A-1

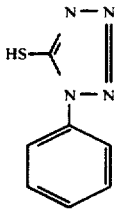

As can be seen from the results shown in Table 2, the compounds of the present invention can depress the generation of fog accompanying a very slight decrease in sensitivity compared with Comparison Compound A-1.

EXAMPLE 4

A silver halide emulsion containing 80 mol% of silver chloride, 19.5 mol% of silver bromide and 0.5 mol% of silver iodide was subjected to gold sensitization and sulfur sensitization. A mean grain size of silver halide grains in the emulsion was 0.31 μm.

To each 1 kg portion of the silver halide emulsion were added the blocked photographic agent of the present invention as shown in Table 3 below, 0.1 g of 3-carboxymethyl-5-(3-ethyl-2-thiazolidinylidenethylidene)rhodanine (spectral sensitizer), 0.18 g of 4-hydroxy-6-methyl-1,3,3a,7-tetraazaindene (stabilizer), 0.45 g of polyalkylene oxide compound (P-21), 1.2 g of sodium dodecylbenzenesulfonate (surface active agent), 0.48 g of mucochloric acid (hardener) and 30 g of a polymer latex as described in Japanese Patent Publication No. 5331/70. The thus prepared emulsion was coated on a polyethylene terephthalate film at a silver coverage of 3.9 g/m$^2$ to produce a photographic material.

The samples thus produced were contacted with a gray contact screen for negative (150 L/inch, produced by Dai-Nippon Screen Co., Ltd.) and exposed to tungsten light (color temperature of 5,400° K.) for 1 second through a step wedge having a difference of 0.1 (log E) in each step. Then, the samples were developed with the lith type developing solution shown below at 27° C. for 100 seconds using an automatic developing machine, stopped, fixed, washed and dried.

| Composition of the Developing Solution | |
|---|---|
| Hydroquinone | 15 g |
| Formaldehyde-Sodium Hydrogensulfite Adduct | 50 g |
| Potassium Carbonate | 30 g |
| Sodium Sulfite | 2.5 g |
| Potassium Bromide | 2.0 g |
| Boric Acid | 5.0 g |
| Sodium Hydroxide | 3.0 g |
| Triethylene Glycol | 40 g |
| Disodium Ethylenediaminetetraacetate | 1.0 g |
| Water to make | 1,000 cc |

The samples thus processed were measured with regard to dot areas of 10%, 50% and 90%, respectively. The sensitivities of the samples were compared by a reciprocal of an exposure amount required for obtaining the dot area of 50%. In addition, the screen range was determined from the difference between the logarithm of the exposure amount providing a dot area of 10% and that of an exposure amount providing a dot area of 90%. The results obtained are shown in Table 3.

TABLE 3

| Sample | Precursor | Amount Added (mol/kg emulsion) | Sensitivity | Fog | Screen Range |
|---|---|---|---|---|---|
| 1 (Control) | — | — | 100 (Standard) | 0.06 | 0.9 |
| 2 (Invention) | (1) | $2.0 \times 10^{-4}$ | 98 | 0.04 | 1.1 |
| 3 (Invention) | (1) | $4.0 \times 10^{-4}$ | 93 | 0.04 | 1.0 |
| 4 (Comparison) | A-1 | $2.0 \times 10^{-4}$ | 48 | 0.04 | 1.0 |
| 5 (Comparison) | A-1 | $4.0 \times 10^{-4}$ | 39 | 0.04 | 1.1 |
| 6 (Invention) | (21) | $2.0 \times 10^{-4}$ | 97 | 0.04 | 1.1 |
| 7 (Invention) | (21) | $4.0 \times 10^{-4}$ | 92 | 0.04 | 1.2 |
| 8 (Comparison) | A-5 | $2.0 \times 10^{-4}$ | 50 | 0.04 | 1.1 |
| 9 (Comparison) | A-5 | $4.0 \times 10^{-4}$ | 35 | 0.04 | 1.2 |

Comparison Compound A-5

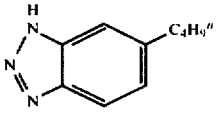

As can be seen from the results shown in Table 3, the compounds of the present invention can depress fog generation without a substantial decrease in the sensitivity and at the same time, the compounds of the present invention can produce an improvement in screen range without a substantial decrease in the sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having coated thereon a light-sensitive silver halide emulsion layer, wherein the photographic material contains at least one blocked photographic agent represented by the following general formula (I):

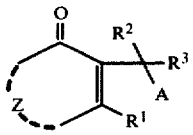

(I)

wherein A represents a photographic agent moiety which is bonded to a blocking moiety through a hetero atom, or a precursor thereof; $R^1$ represents a member selected from the group consisting of a hydrogen atom, an alkyl group, an alkenyl group, an aryl group, an alkoxy group, an oxycarbonyl group, a carbamoyl group, an acyl group, a sulfonyl group, a sulfinyl group and a sulfamoyl group, and $R^2$ and $R^3$ each represents a hydrogen atom, or a substituent group; and Z represents atoms necessary to form a cyclopentenone ring, a cyclohexenone ring, a cycloheptenone ring, a benzocycloheptenone ring, a 4-pyridone ring, a 4-quinolone ring, a 2-pyrone ring, a 4-pyrone ring, a 1-thio-2-pyrone ring, a 1-thio-4-pyrone ring, a coumarin ring, a chromone ring or a uracil ring, provided that said uracil ring has an alkyl group on the N atom adjacent to the carbon atom to which $R^1$ is attached and provided that none of said rings contains an >NH group at the position adjacent to the carbon atom to which $R^1$ is attached.

2. A silver halide photographic material as in claim 1, wherein A is a group represented by the following general formula (II):

$$-(X)_m B \quad \text{(II)}$$

wherein B represents a photographic agent moiety which is bonded to X through a hetero atom contained in B; X represents a divalent linkage group which is bonded to a blocking moiety through a hetero atom contained in X; and m is 0 or 1.

3. A silver halide photographic material as in claim 2, wherein the photographic agent moiety represented by B is selected from the group consisting of an antifoggant, a development inhibitor, a developing agent, an auxiliary developing agent, a fogging agent, a silver halide solvent, a bleach accelerating agent and a dye.

4. A silver halide photographic material as in claim 3, wherein the photographic agent is selected from the group consisting of mercaptotetrazoles, mercaptotriazoles, mercaptopyrimidines, mercaptobenzimidazoles, mercaptoimidazoles, mercaptobenzoxazoles, mercaptobenzthiazoles, mercaptothiadiazoles, benzotriazoles and indazoles.

5. A silver halide photographic material as in claim 3, wherein the photographic agent is selected from the group consisting of p-phenylenediamines, hydroquinones and p-aminophenols.

6. A silver halide photographic material as in claim 3, wherein the photographic agent is selected from pyrazolidones.

7. A silver halide photographic material as in claim 3, wherein the photographic agent is selected from the group consisting of hydrazines and hydrazides.

8. A silver halide photographic material as in claim 3, wherein the photographic agent is sodium thiosulfate.

9. A silver halide photographic material as in claim 3, wherein the photographic agent is selected from aminoalkylthiols.

10. A silver halide photographic material as in claim 3, wherein the photograhic agent is selected from the group consisting of azo dyes and azomethine dyes.

11. A silver halide photographic material as in claim 2, wherein the photographic agent moiety represented by B is a coloring material for a color diffusion transfer photographic material or a development inhibitor releasing hydroquinone.

12. A silver halide photographic material as in claim 2, wherein the photographic agent moiety represented by B is directly bonded to the blocking moiety through a hetero atom contained therein.

13. A silver halide photographic material as in claim 2, wherein the photographic agent moiety represented by B is bonded to the divalent linkage group represented by X through a hetero atom contained therein.

14. A silver halide photographic material as in claim 2, wherein the divalent linkage group represented by X is a group which releases the photographic agent by an intramolecular ring closing reaction, a group which releases the photographic agent through intramolecular electron transfer, a group which releases the photographic agent with the elimination of carbon dioxide or a group which releases the photographic agent with the elimination of formaldehyde.

15. A silver halide photographic material as in claim 14, wherein X is a group represented by the folowing formulae:

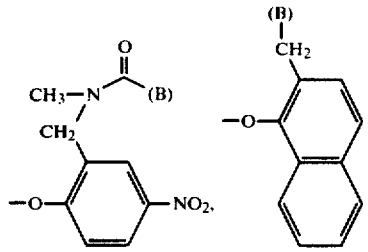

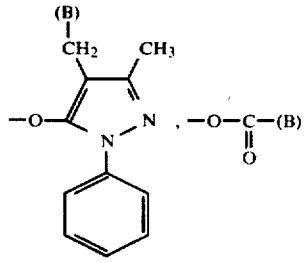

$-OCH_2-(B)$, $-O-\underset{\underset{O}{\|}}{C}-OCH_2-(B)$ wherein -(B) represents a bond to the photographic agent moiety.

16. A silver halide photographic material as in claim 1, wherein $R^2$ and $R^3$ each represents a hydrogen atom, an alkyl group or an aryl group.

17. A silver halide photographic material as in claim 2, wherein m is 0.

18. A silver halide photographic material as in claim 1, wherein said ring may be substituted with one or more substituents selected from the group consisting of a halogen atom, an alkyl group, an aryl group, an alkoxy group, an aryloxy group, an alkylthio group, an arylthio group, an acyl group, an acylamino group, a nitro group, a cyano group, an oxycarbonyl group, a hydroxy group, a carboxy group, a sulfo group, a ureido group, a sulfonamido group, a sulfamoyl group, a carbamoyl group, an acyloxy group, an amino group, a carbonic acid ester group, a sulfone group and a sulfinyl group.

19. A silver halide photographic material as in claim 1, wherein the blocked photographic agent is present in a silver halide emulsion layer, a coupler layer, a subbing layer, a protective layer, an interlayer, a filter layer, an antihalation layer, an image receiving layer, a cover sheet layer, or an auxiliary layer.

20. A silver halide photographic material as in claim 1, wherein the blocked photographic agent is an antifoggant and the blocked photographic agent is contained in the photographic material in an amount of $10^{-8}$ to $10^{-1}$ mol per mol of silver in the silver halide emulsion.

21. A silver halide photographic material as in claim 1, wherein the blocked photographic agent is a development inhibitor and the blocked photographic agent is contained in the photographic material in an amount of $10^{-8}$ to $10^{31\ 1}$ mol per mol of silver in the silver halide emulsion.

22. A silver halide photographic material as in claim 1, wherein the blocked photographic agent is a developing agent and the blocked photographic agent is contained in the photographic material in an amount of $10^{-2}$ to 10 mol per mol of silver in the silver halide emulsion.

23. A silver halide photographic material as in claim 1, wherein the blocked photographic agent is an auxiliary developer of a pyrazolidone type and the blocked photographic agent is contained in the photographic material in an amount of $10^{-4}$ to 10 mol per mol of silver in the silver halide emulsion.

24. A silver halide photographic material as in claim 1, wherein the blocked photographic agent is a fogging agent and the blocked photographic agent is contained in the photographic material in an amount of $10^{-2}$ to $10^{-6}$ mol per mol of silver in the silver halide emulsion.

25. A silver halide photographic material as in claim 1, wherein the blocked photographic agent is a silver halide solvent and the blocked photographic agent is contained in the photographic material in an amount of $10^{-3}$ to 10 mol per mol of silver in the silver halide emulsion.

26. A silver halide photographic material as in claim 1, wherein the blocked photographic agent is a bleach accelerating agent and the blocked photographic agent is contained in the photographic material in an amount of $10^{-5}$ to $10^{-1}$ mol per mol of silver in the silver halide emulsion.

27. A silver halide photographic material as in claim 1, wherein the blocked photographic agent is a dye and the blocked photographic agent is contained in an amount of $10^{-3}$ to 1 mol per mol of silver in the silver halide emulsion.

28. A silver halide photographic material as in claim 1, wherein the blocked photographic agent is a coloring agent for color diffusion transfer photographic light-sensitive material and the blocked photographic agent is contained in an amount of $10^{-3}$ to 1 mol per mol of silver in the silver halide emulsion.

29. A silver halide photographic material as in claim 1, wherein the blocked photographic agent is represented by the following general formula (III):

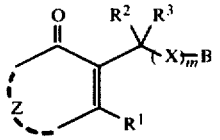

(III)

wherein B represents a photographic agent moiety which is bonded to X through a hetero atom contained in B; X represents a divalent linkage group which is bonded to a blocking moiety through a hetero atom contained in X; m is 0 or 1; $R^1$ represents a hydrogen atom, or a substituent selected from the group consisting of an alkyl group, an alkenyl group, an aryl group, an alkoxy group, an oxycarbonyl group, a carbamoyl group, an acyl group, a sulfonyl group, a sulfinyl group, and a sulfamoyl group; $R^2$ and $R^3$ each represents a hydrogen atom, an alkyl group, or an aryl group; and Z is as defined in claim 1.

30. A silver halide photographic material as in claim 2, wherein m is 1.

31. A silver halide photographic material as in claim 30, wherein the bond formed between X and the blocking moiety is cleaved upon processing and the resulting X-B moiety splits per se rapidly to release a photographic agent corresponding to B.

32. A silver halide photographic material as in claim 1, wherein A is a group represented by the following general formula (II):

$$-(X)_m B \qquad \text{(II)}$$

wherein B represents a photographic agent moiety which is bonded to X through a heteroatom contained in B; X represents a divalent linkage group which is bonded to a blocking moiety through a heteroatom contained in X; m is 0 or 1 and wherein the photographic agent moiety represented by B is a developing agent selected from the group consisting of p-phenylene diamines, hydroquionones and p-aminophenols.

* * * * *